US005441006A

United States Patent [19]

Wood

[11] Patent Number: 5,441,006

[45] Date of Patent: Aug. 15, 1995

[54] SPACER ASSEMBLY PARTICULARLY USEFUL AS A BOAT FENDER

[76] Inventor: Andrew K. Wood, 1207 Beaver Rd., Glen Osborne, Pa. 15143

[21] Appl. No.: 359,023

[22] Filed: Dec. 19, 1994

[51] Int. Cl.[6] ..... B63B 59/02

[52] U.S. Cl. ..... 114/220; 441/35; 441/80

[58] Field of Search ..... 114/219, 220, 266, 267; 441/35, 80, 129, 136

[56] References Cited

U.S. PATENT DOCUMENTS

| | | | |
|---|---|---|---|
| 4,376,419 | 3/1983 | Heilskov | 114/219 |
| 4,875,427 | 10/1989 | Harris, Jr. | 114/219 |

FOREIGN PATENT DOCUMENTS

| | | | |
|---|---|---|---|
| 1297238 | 5/1962 | France | 114/220 |
| 1037904 | 8/1958 | Germany | 441/80 |
| 450406 | 7/1936 | United Kingdom | 441/35 |

*Primary Examiner*—Jesus D. Sotelo
*Attorney, Agent, or Firm*—Harry B. Keck

[57] ABSTRACT

Protective mat assemblies are formed from lightweight beads which are secured together in a generally rectangular array. The beads have unobstructed longitudinal central openings to receive a rope. Certain of the beads have permanent rope members including an eyelet at each end of the rope member. The beads are secured by a forming rope which passes alternately through plain beads and through eyelets of second beads. Fastening elements are provided along one side of the resulting rectangular mat.

6 Claims, 2 Drawing Sheets

SPACER ASSEMBLY PARTICULARLY USEFUL AS A BOAT FENDER

BACKGROUND OF THE INVENTION

1. Field of the Invention

This invention relates to lightweight mats which are particularly useful as boat fenders, that is, mats which are secured at their top and which depend along an outboard side of a boat to protect the boat sides from contact with other boats and contact with moorings for boats. The mats are formed from lightweight beads having a central unobstructed ropeway and from ropes securing the beads in a rectangular array.

2. Description of the Prior Art

Boat fenders have been employed since antiquity to protect the sides of boats from damage through contact with other boats or through contact with mooring structures. Customarily the boat fenders are fabricated from resilient members which absorb energy in compression and thereby insulate a protected boat from mechanical contacts along the sides of the boat.

Rubber hoses on ropes have been employed, positioned generally horizontally at an appropriate level along the side of a boat, U.S. Pat. No. 2,062,919. Hollow elastic cylinders have been employed, generally horizontally disposed along the side of a boat, U.S. Pat. No. 3,292,566. Rectangular hollow bumpers having transverse bores are positioned vertically or horizontally along the side of a boat, U.S. Pat. No. 3,183,857. Ladder structures having flexible linear members and rigid step members are provided with multiple tubular spacers, formed from synthetic resins. The ladder structure is mounted on the outer surface of a boat with the rigid step members being generally horizontal, U.S. Pat. No. 4,376,419.

STATEMENT OF THE PRESENT INVENTION

According to the present invention, a spacer assembly is formed from multiple plastic beads, each having a ropeway at its central longitudinal axis extending from opposed openings in the bead casing. Such beads are frequently used in swimming pools to define the location of the shallow water and the deep water. In the swimming pool use, a water resistant rope is extended through ropeways of multiple beads. The ends of the rope are secured adjacent to the top surface of the swimming pool water. The beads, usually brightly colored, support the rope at the surface of the pool water and provide a clear visible indication of the common side of the two pool sections.

Similar beads are employed in this invention. There are first beads which correspond to the prior art swimming pool rope beads, i.e., have an external skin and a longitudinal ropeway extending from opposed openings of the skin. There are second beads, similar in all respects to first beads except that the second beads include a supporting rope extended through the ropeway and having an eyelet formed in the rope at each end, externally of the bead. The invention further includes one or more forming ropes extending through the ropeways of first beads and through one or more eyelets of second beads. When assembled as herein described, the first beads, second beads and forming ropes define a generally rectangular spacer assembly. Appropriate hanging means many be secured to the assembly to permit rapid and secure temporary fastening of the spacer assembly on the side of a boat or on the side of a mooring structure. A perimeter rope is employed in a preferred embodiment of the invention.

It is an object of this invention to provide a low cost, corrosion resistant spacer assembly which can be assembled in various sizes and patterns.

A further object of the invention is to provide a low cost, corrosion resistant spacer assembly which can easily be installed and dismantled by a boat operator or mooring operator.

A further object of the invention is to provide a visually attractive spacer assembly which can be used as a boat fender.

DESCRIPTION OF THE PREFERRED EMBODIMENTS

Figure 1:
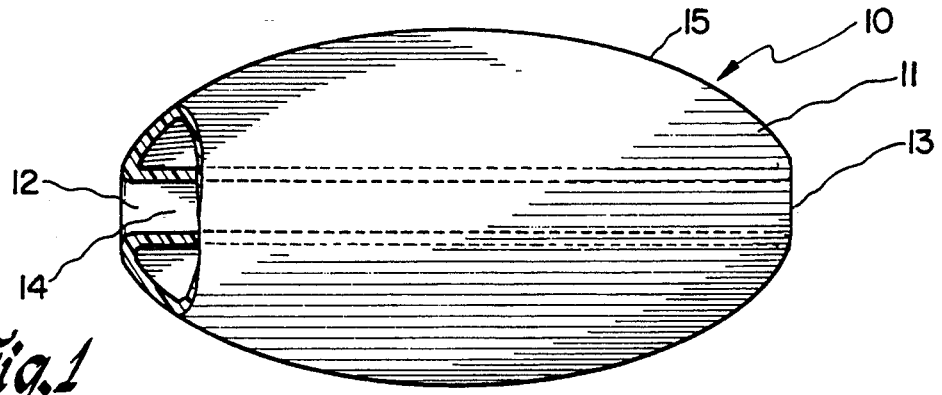
FIG. 1 is an illustration of a bead employed in the novel spacer assembly.

FIG. 1 illustrates a first bead 10 having a continuous casing or skin 11 with openings 12, 13 and a longitudinal ropeway 14. The first bead 10 has a length of 15–60 centimeters and a maximum diameter of 7–30 centimeters. The first bead skin 11 preferably is formed from plastic materials which are light weight, impervious to water and resilient, for example, polyethylene, polypropylene, polystyrene.

In all embodiments of the first bead 10, the ropeway 14 is an unobstructed passageway of sufficient diameter to receive a rope, preferably from 1–5 centimeters diameter.

Figure 2:
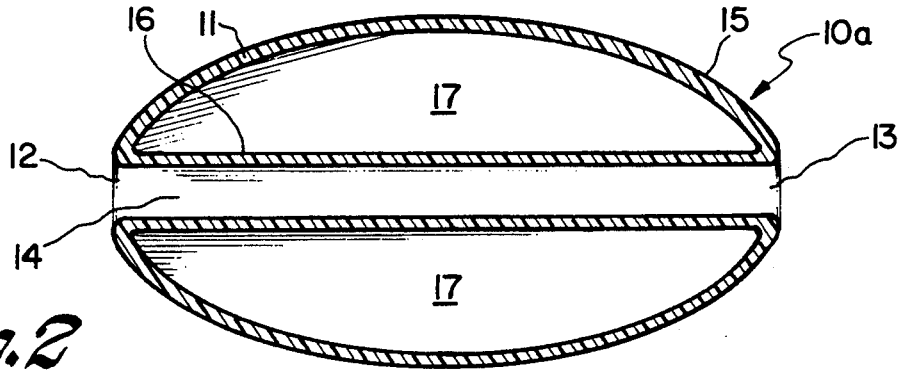
FIG. 2 is a cross-section of the bead of FIG. 1 in a preferred embodiment.

As illustrated in FIG. 2, the first bead **10*a* is formed from a single piece of plastic having an outer skin 15 and an inner skin 16. A hollow annular space 17 is formed between the outer skin 15 and inner skin 16. The first bead 10*a*** is preferably blow-molded from plastics such as polyethylene, polypropylene and polystyrene.

Figure 3:
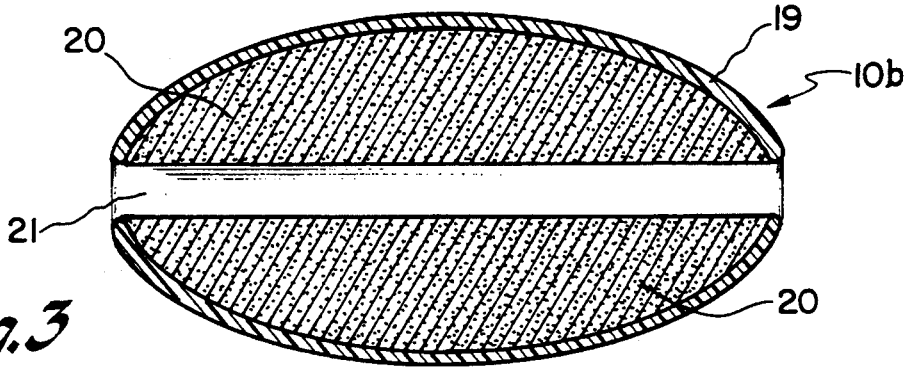
FIG. 3 is an alternative embodiment of the bead illustrated in FIG. 1.

Another embodiment of the first bead **10*b* is shown in FIG. 3 wherein an outer skin 19 is filled with lightweight, closed-cell, resinous foam 20 having a bore 21** which functions as a ropeway. The resinous foam is preferably expanded polystyrene, closed-cell polyurethane or polyethylene foam.

Figure 4:
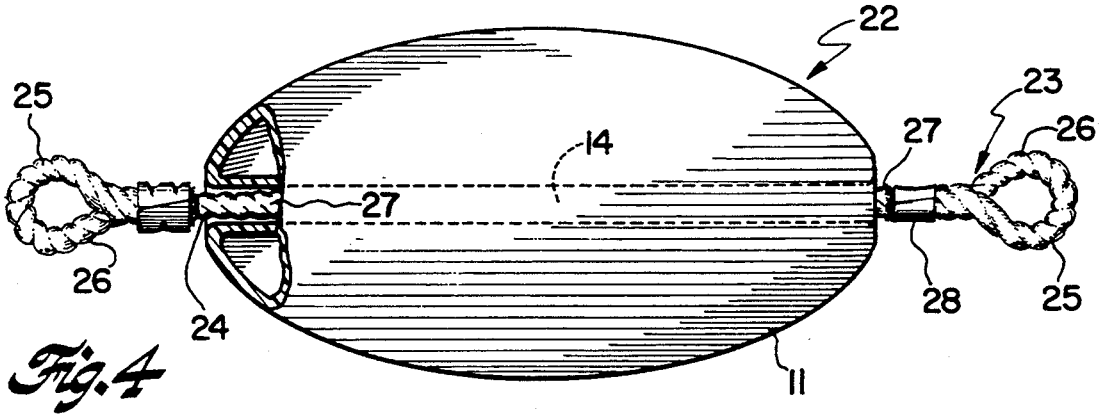
FIG. 4 is an illustration of the bead of FIG. 1 having a first rope member positioned in the ropeway.

FIG. 4 illustrates a second bead 22 which has all of the elements of a first bead 10 as shown in FIG. 1, and also includes a supporting rope member 23 which has a length of corrosion resisting rope 24 passing through a ropeway 14 and has an eyelet 25 at each end. The eyelets 25 are larger than the ropeway 14 to retain the supporting rope together with the second bead 22. The rope 24 preferably is a corrosion resistant nylon rope or polypropylene rope. The eyelet 25 may be formed by appropriate adhesives connecting a free end 26 of the rope to a main body of the rope at 27. Alternatively a strong corrosion resistant tape 28 may be wrapped around a free end and the main body of the rope. Other eyelet formations employ splicing, corrosion resistant metal fasteners and the like. If the rope 24 is thermoplastic, the eyelet 25 may be formed by thermal fusion of a free end of the rope with a body portion of the rope.

The skin 11, 19 is preferably formed from brightly colored plastic materials, similar to floats which are employed with swimming pool ropes.

The Mat Assembly

Figure 5:
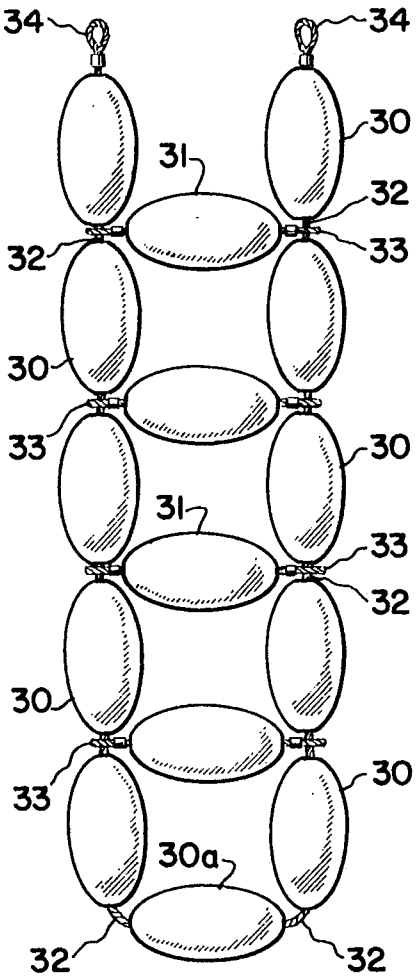
FIG. 5 is an illustration of a spacer according to this invention.

The mat assembly of this invention is illustrated in an elementary embodiment in FIG. 5 wherein multiple first beads 30 and multiple second beads 31 with a forming rope 32 which passes through first beads 30, eyelets 39 (of second beads 31) to form a ladder-like assembly. The forming rope 32 has eyelets 34 to secure the assembly and to provide a hanging means for the assembly. It will be noted that the bottom-most bead 30*a* is a first bead through which the forming rope 32 passes. The resulting mat of FIG. 5 is a generally rectangular structure.

Figure 6:
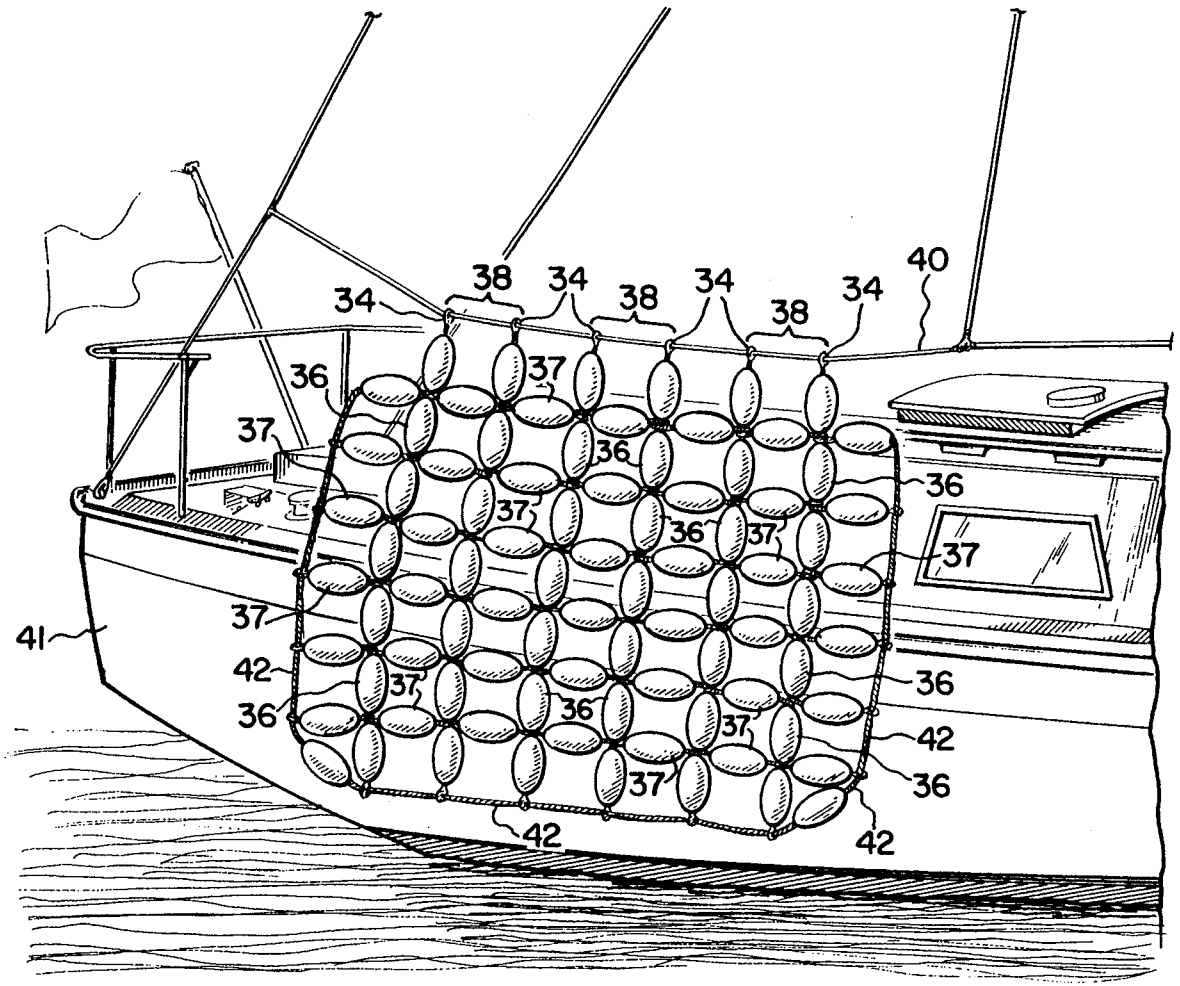
FIG. 6 is an illustration of a spacer assembly, larger than that of FIG. 5.

In FIG. 6 a larger bead assembly is illustrated having a width of seven beads and a height of seven beads. Seven rows of first beads 36 and seven rows of second beads 37 are illustrated. Three individual forming ropes 38 are illustrated each having, at each end, an eyelet 39 to permit the mat assembly to be strung along a generally horizontal rope 40, secured to a boat 41.

If the mat assembly has second beads 37 along each side, it is preferred to insert a perimeter rope 42 through the outer single eyelets 34.

General

The mat assembly of this invention can be formed in various widths and various lengths according to the number of first beads and number of second beads in the assembly. If the beads in FIG. 5 are approximately 12 inches long, the mat illustrated in FIG. 6 would have overall dimensions about 8.5 feet square. The mat would be positioned at appropriate locations along the outboard side of boat 41 to be selected in accordance with the skill and experience of the boat operator. The mat of FIG. 5 can be easily installed and easily removed and transferred to another location.

I claim:

1. A spacer assembly comprising multiple low density first beads, each of said first beads having an unobstructed ropeway extending through the bead between two rope-receiving openings in the skin of the bead; multiple low density second beads, each of said second beads having two eyelets extending from opposite ends of said second bead; a first rope extending through said ropeways of said first beads and then through eyelets of said second beads; a connecting member at each end of said rope for supporting the spacer assembly.

2. The spacer assembly of claim 1 wherein said beads are large thermoplastic beads having a tubular opening extending from one end to the other end, defining a closed annular chamber.

3. The spacer assembly of claim 1 wherein said beads are formed from expanded plastic.

4. The spacer assembly of claim 3 wherein said beads are formed from expanded polystyrene.

5. The spacer assembly of claim 1 wherein said beads have an outer bead casing and the interior is filled with expanded plastic material, an unobstructed ropeway extending through said expanded plastic material from one end of said casing to the opposed end or said casing.

6. A bumper construction formed from multiple, resilient ellipsoid-shaped first and second beads, each bead having a longitudinal central unobstructed ropeway; said second beads having a rope element extending through said ropeway and having an eyelet at each end of said rope element; said first beads being secured by a forming rope element extending sequentially through multiple aligned first beads and extending through at least one eyelet of said second bead, the overall assembly comprising a general flat construction; fastening means secured to at least one edge of said assembly to fasten said assembly in a depending disposition.

* * * * *